US007534061B2

(12) United States Patent
Kaneko et al.

(10) Patent No.: US 7,534,061 B2
(45) Date of Patent: May 19, 2009

(54) SHEET CUTTING APPARATUS AND IMAGE FORMING SYSTEM

(75) Inventors: Masahiro Kaneko, Hino (JP); Toshio Shida, Higashiyamato (JP); Hiroyuki Wakabayashi, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 212 days.

(21) Appl. No.: 11/175,853

(22) Filed: Jul. 6, 2005

(65) Prior Publication Data

US 2006/0072954 A1 Apr. 6, 2006

(30) Foreign Application Priority Data

Oct. 6, 2004 (JP) ..... 2004-293479

(51) Int. Cl.
*B41J 11/00* (2006.01)

(52) U.S. Cl. ..... 400/621; 83/56

(58) Field of Classification Search ..... 83/638; 400/621

See application file for complete search history.

(56) References Cited

U.S. PATENT DOCUMENTS 4,179,108 A * 12/1979 Grimm et al. ..... 270/30.12
4,754,962 A * 7/1988 Kontz ..... 271/307
6,581,930 B2 * 6/2003 Kim ..... 271/272
6,769,466 B2 * 8/2004 Osumi et al. ..... 156/351
2004/0096253 A1 * 5/2004 Ueno et al. ..... 399/385

FOREIGN PATENT DOCUMENTS

JP 6-71596 A 3/1994
JP 2003-136471 5/2003
JP 2003-136471 A2 5/2003
JP 2004-114198 4/2004

OTHER PUBLICATIONS

Japanese Office Action for Application No. JP2004-293479 (with English Translation) mailed Mar. 18, 2008.
Office Action for corresponding Japanese Patent Application No. 2004-293479 mailed Jul. 4, 2007.

* cited by examiner

*Primary Examiner*—Daniel J Colilla
*Assistant Examiner*—Marissa L Ferguson-Samreth
(74) *Attorney, Agent, or Firm*—Canton Colburn LLP

(57) ABSTRACT

Replacement time for the cutting board used in the sheet cutting apparatus is detected. A sheet cutting apparatus has a cutting blade to cut a set of sheets by moving in an oblique direction which includes first component of a perpendicular direction to a face of the set of sheets and as second component of a parallel direction to the face, a cutting board to receive the cutting blade, a movable unit to move the cutting board to a face of the cutting blade, and an end detector to detect a movable end of the cutting board.

18 Claims, 13 Drawing Sheets

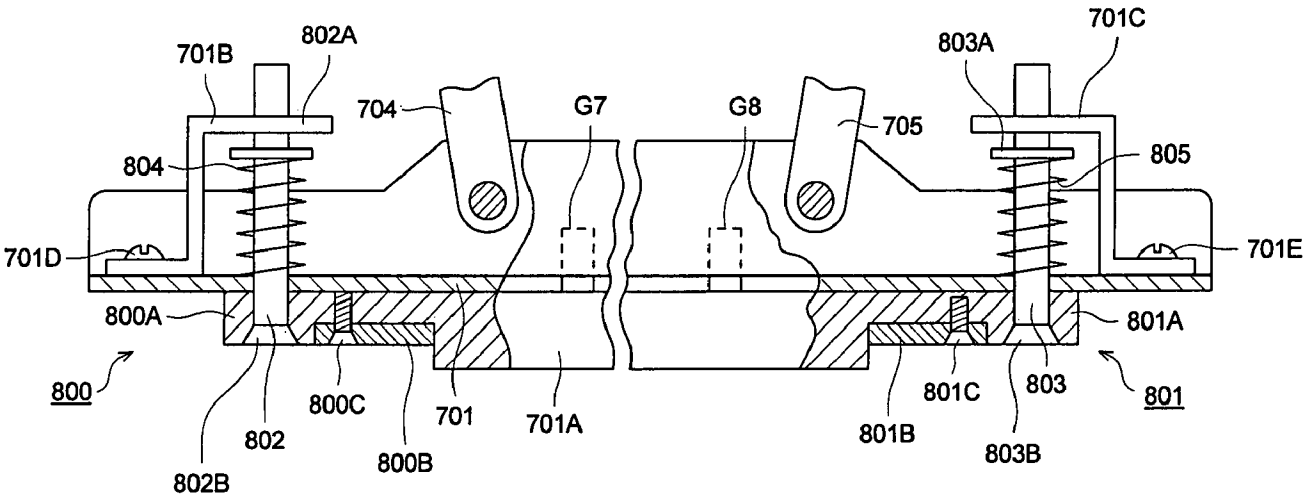
FIG. 10 ( a )
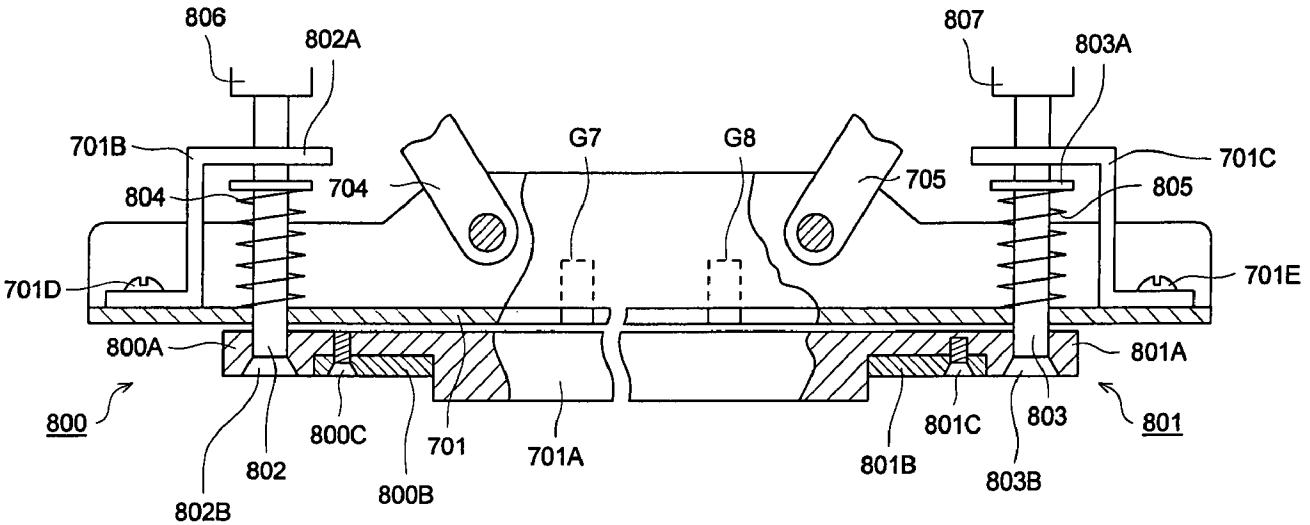
FIG. 10 ( b )

SHEET CUTTING APPARATUS AND IMAGE FORMING SYSTEM

RELATED APPLICATION

This application is based on patent application No. 2004-293479 filed in Japan, the entire content of which is hereby incorporated by reference.

BACKGROUND

1. Field of the Invention

The present invention relates to a sheet cutting apparatus that cuts a plurality of sheets of paper, in particular, to image forming systems such as a copying machine, a printer, a facsimile machine and a multi-functional machine having two or more functions of the aforementioned machines and the printers, and to a sheet cutting apparatus that can be incorporated in the aforesaid image forming system.

2. Description of the Related Art

As a sheet finishing apparatus to be incorporated in an image forming apparatus, there has been developed an apparatus having a function to make a booklet by binding a plurality of sheets of paper. In many of the sheet finishing apparatuses, sheets of paper are folded at their center portions, then, the center portions of the sheets are bound, and a side of the folded sheets opposite to the bound portion, namely, an edge of the folded sheets is cut by the sheet cutting apparatus to be trued up, whereby, a booklet is formed.

The sheet cutting apparatus to be incorporated in a sheet finishing apparatus is one constituting a part of an image forming system installed in a copy center or an office. Therefore, it is required to be small in size, and can operate with small electric power, and its function to true up an edge of sheets finely needs to be maintained stably. If irregularity such as ruggedness is caused on a section of the edge or if an uncut portion remains, there is caused a problem that a booklet is degraded such as opening of the booklet that is not smooth.

A sheet cutting apparatus used in a process to manufacture a large quantity of the same booklets as in printed matters is one that is in a large scale and is driven with large electric power, and therefore, it has only to have high cutting capability. However, in the case of a sheet cutting apparatus used as a part of an image forming system, it is required to be small in size, and to be capable of operating with small electric power as stated above. Thus, it needs to have conceptions which are not owned by the sheet cutting apparatus used for a large-sized apparatus.

In Japanese published unexamined application No. 2003-136471, there is disclosed a sheet cutting apparatus wherein a cutting blade is pressed obliquely against a surface of a bundle of sheets to cut, as a sheet cutting apparatus usable for a business machine.

In the sheet cutting apparatus disclosed in Japanese published unexamined application No. 2003-136471, there is used a cutting board that presses sheets to be cut and holds a cutting blade, and on the cutting board, there are formed grooves by repeated cutting operations. Because of the grooves, the cutting is not carried out high accuracy.

An object of the invention is to improve practicality of the sheet cutting apparatus. Specifically, an object of the invention is to provide a sheet cutting apparatus having high practicality which conducts replacement of unused portions of the cutting board repeatedly, and detects that usable portions of the cutting board have been used up.

SUMMARY

The objects of the invention stated above are attained by the following inventions.

A sheet cutting apparatus having: a cutting blade to cut a set of sheets by moving in an oblique direction which includes first component of a perpendicular direction to a face of the set of sheets and as second component of a parallel direction to the face; a cutting board to receive the cutting blade; a movable unit to move the cutting board to a face of the cutting blade; and an end detector to detect a movable end of the cutting board.

The invention itself, together with further objects and attendant advantages, will best be understood by reference to the following detailed description taken in conjunction with the accompanying drawings.

BRIEF DESCRIPTION OF THE DRAWINGS

FIG. 10 is a diagram showing both end portions of sheet-pressing member 701.

In the following description, like parts are designated by like reference numbers throughout the several drawings.

DESCRIPTION OF THE PREFERRED EMBODIMENT

Figure 1:
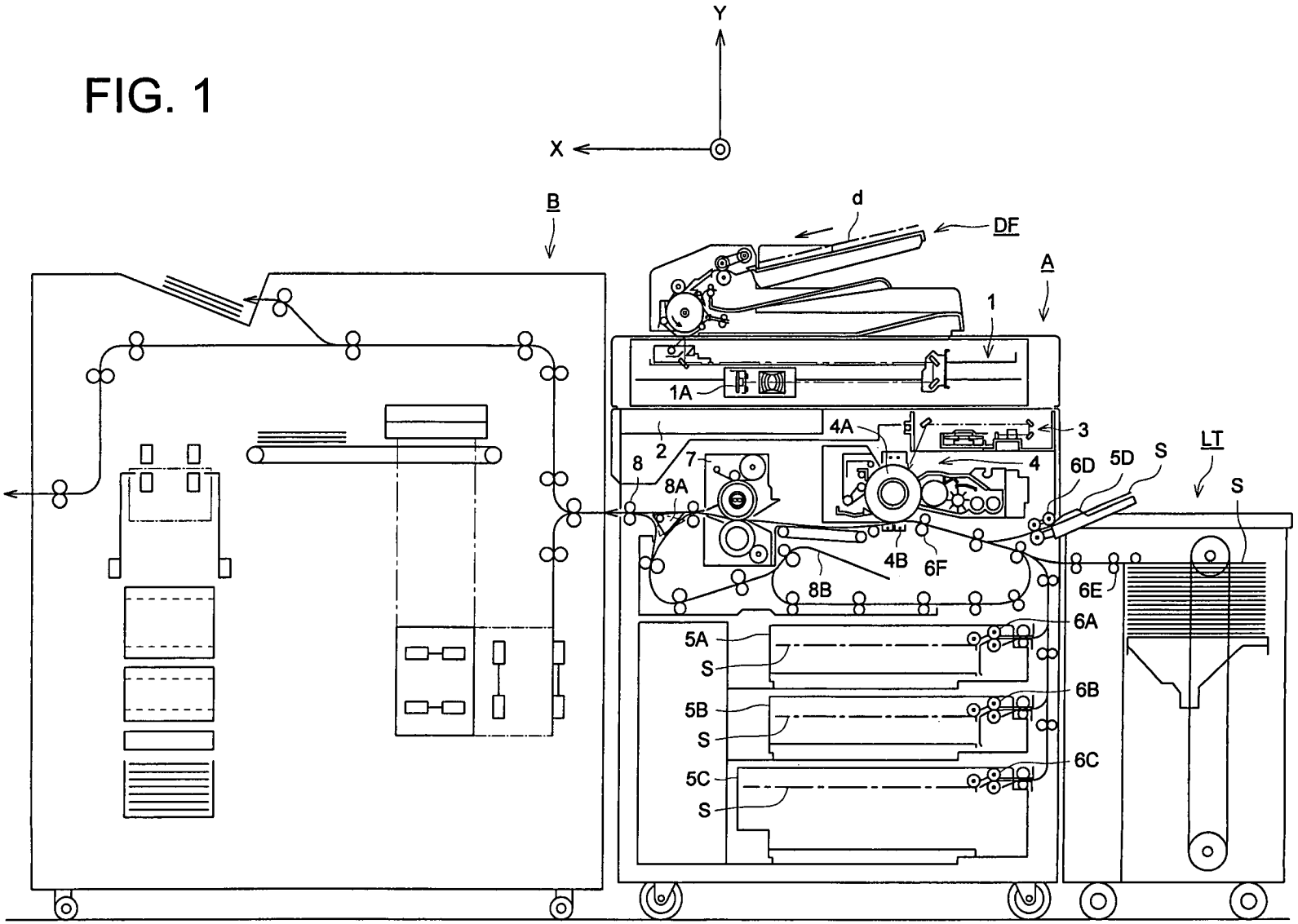
FIG. 1 is a general structure diagram of an image forming system having a sheet cutting apparatus related to the embodiment of the invention.

The embodiment of the invention will be explained as follows, referring to the drawings.

FIG. 1 is a general structure diagram of an image forming system having a sheet cutting apparatus and a sheet cutting apparatus related to the embodiment of the invention.

The symbol A represents an image forming apparatus, DF represents an automatic document feeder, LT represents a large capacity sheet feeding unit and B represents a sheet finishing apparatus.

Image forming apparatus A is provided with image reading section (image input device) 1, image processing section 2, image writing section 3, image forming section 4, sheet-feed cassettes 5A, 5B and 5C, manual sheet-feed tray 5D, first sheet-feed sections 6A, 6B, 6C, 6D and 6E, registration roller 6F, fixing unit 7, sheet ejection section 8, and with automatic duplex copy sheet-feeder (ADU) 8B.

The automatic document feeder DF is provided on the top of image forming apparatus A, and sheet finishing apparatus B is connected integrally to the left side in the drawing.

Document d placed on a document table of the automatic document feeder DF is conveyed in the arrowed direction, and images on one side or both sides of the document are read by an image sensor 1A composed of CCD, by an optical system of image reading section 1.

Analog signals generated after photoelectric conversion by image sensor 1A are sent to image writing section 3 as image information signals, after being subjected to analog processing, A/D conversion, shading correction and to image compression processing.

Image forming section 4 is a portion for forming an image by the use of an electrophotographic process, and processes such as charging, exposure, developing, transferring, separation and cleaning are conducted on photoreceptor drum 4A. In the step of the aforesaid exposure process, the photoreceptor drum 4A is irradiated by output light emitted from a semiconductor laser (not shown) based on the image information signals, and electrostatic latent images are formed. Further, in the step of the aforesaid developing process, toner images corresponding to the electrostatic latent images are formed.

If any one of sheet-feed cassettes 5A-5C, manual sheet-feed tray 5D, large capacity sheet feeding unit LT and first sheet-feed sections 6A-6E corresponding to the foregoing is selected, sheet S is conveyed toward registration roller 6F. The sheet S is synchronized with toner images on photoreceptor drum 4A by the registration roller 6F, and toner images are transferred toward transfer means 4B.

The sheet S carrying the toner images is fixed by fixing unit 7, and is fed into sheet finishing apparatus B from sheet ejection section 8.

When forming images on both sides, the sheet S on which an image is formed on one side is fed into automatic duplex copy sheet-feeder 8B by conveyance path switching plate 8A, and is subjected to image forming on its opposite side in image forming section 4. Then, the sheet S is fixed by fixing unit 7, and is fed into sheet finishing apparatus B from sheet ejection section 8.

Next, an outline of the sheet finishing apparatus B will be explained by using FIGS. 2, 3, 4 and 5.

Figure 2:
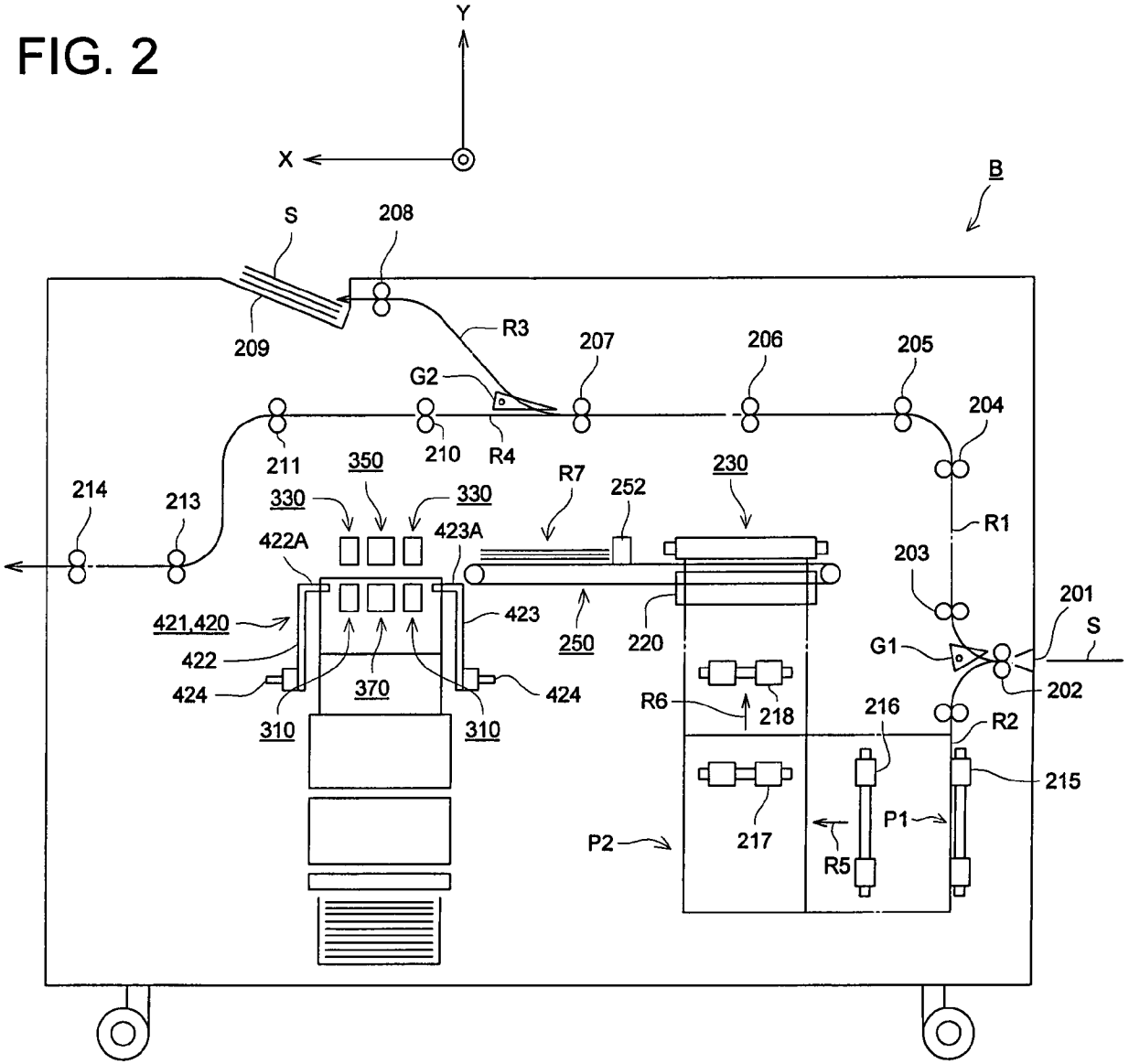
FIG. 2 is a schematic front view of a finishing apparatus related to the embodiment of the invention.
Figure 3:
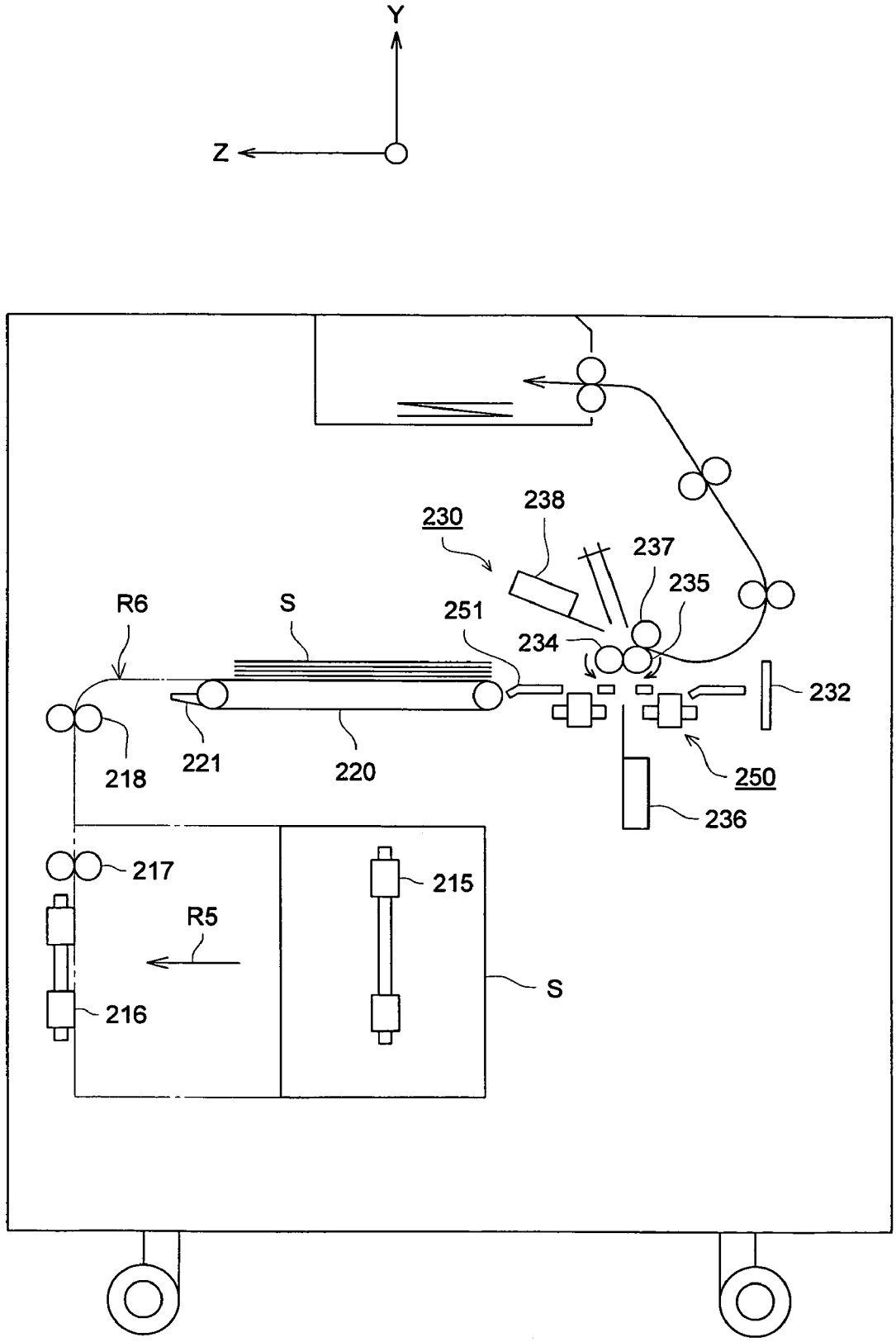
FIG. 3 is a right side view of the finishing apparatus shown in FIG. 2.
Figure 4:
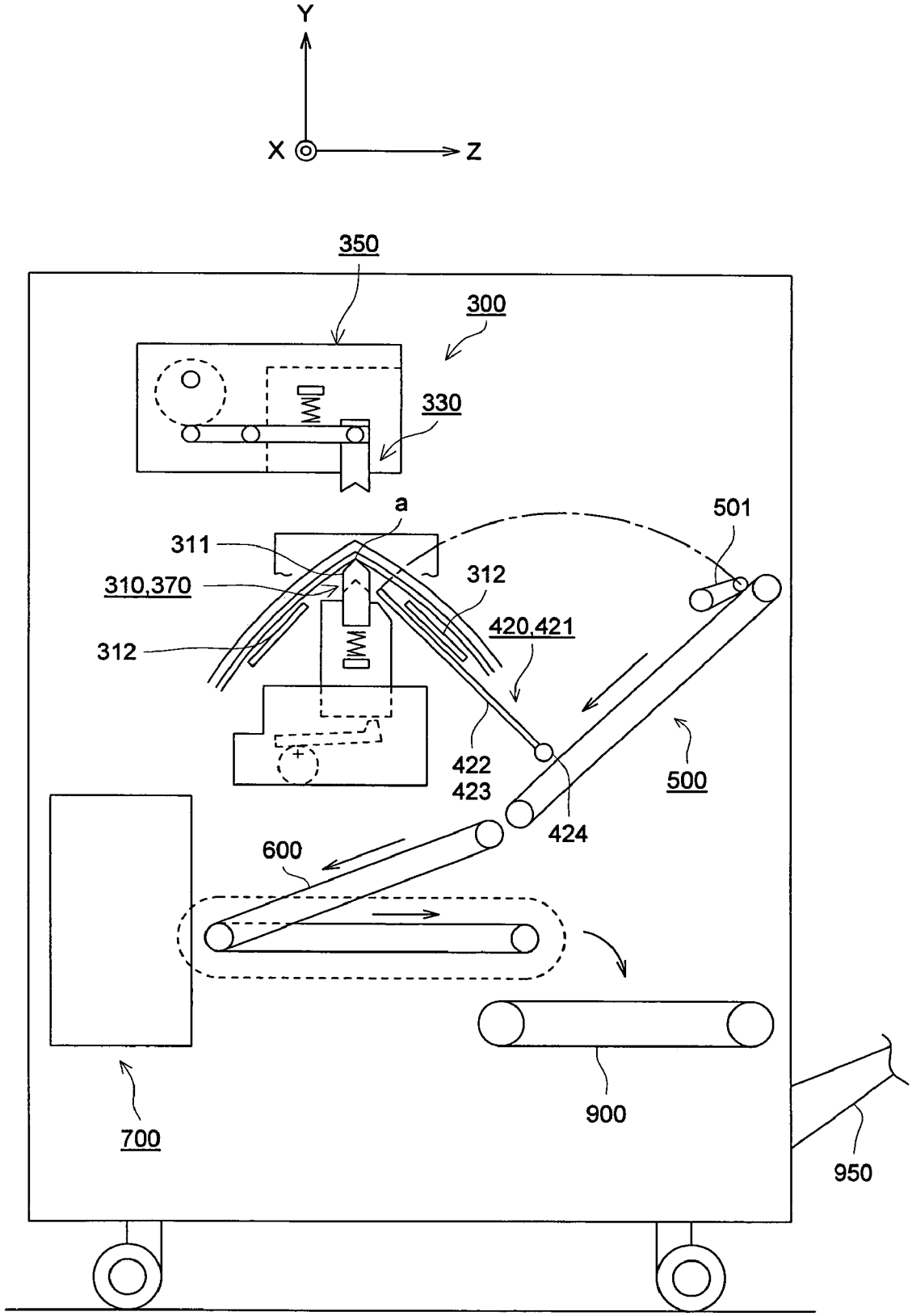
FIG. 4 is a left side view of the finishing apparatus shown in FIG. 2.
Figure 5:
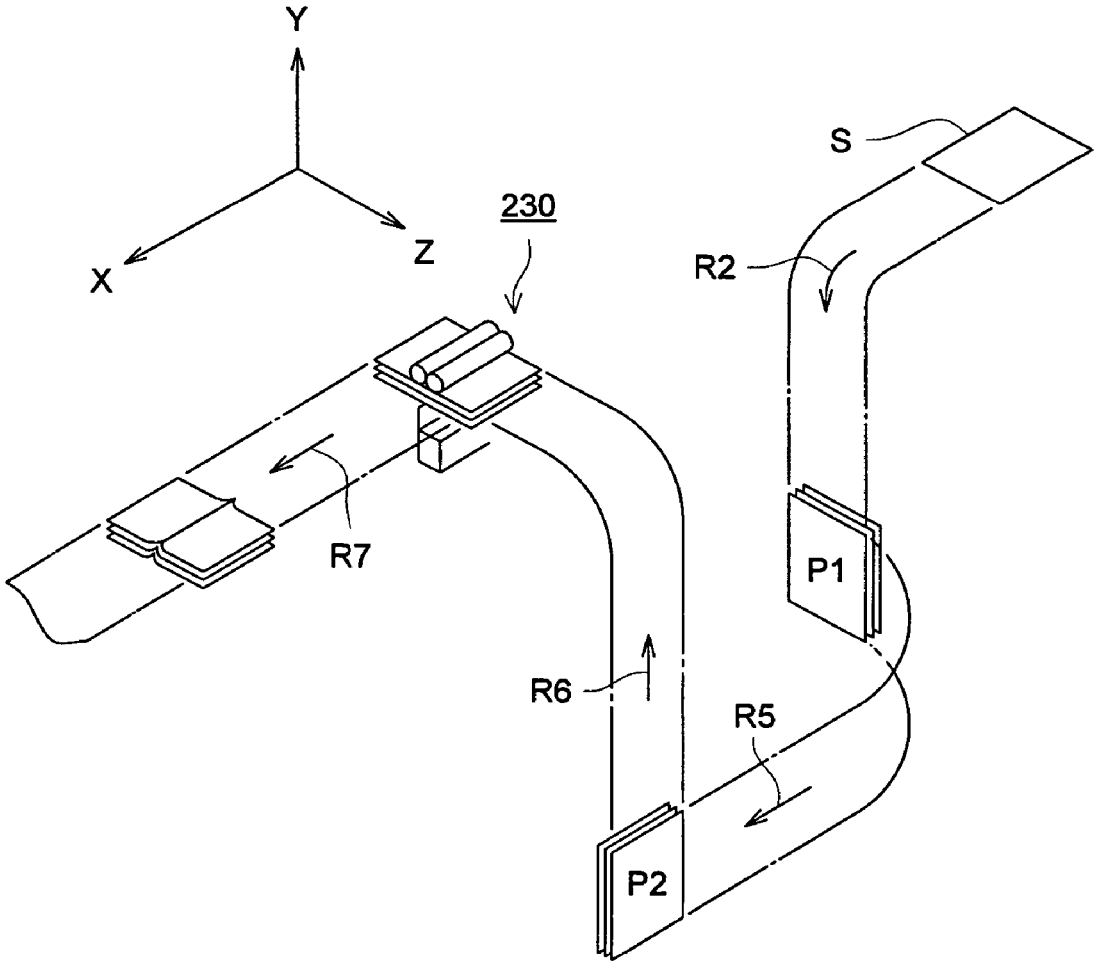
FIG. 5 is a schematic view showing a part of a flow of a sheet in the finishing apparatus.

FIG. 2 is a front view of the sheet finishing apparatus related to the present embodiment, FIG. 3 is a right side view, FIG. 4 is a left side view and FIG. 5 is a schematic diagram showing a part of the flow of the sheet in the sheet finishing apparatus.

In each diagram, arrows X, Y and Z are axes of rectangular coordinates each representing a direction, and it is assumed that positive directions of each coordinate are called respectively an X direction, a Y direction and a Z direction, while, negative directions are called respectively a reverse X direction, a reverse Y direction and a reverse Z direction.

Incidentally, the symbol "◎" represents an occasion wherein a direction intersects a surface of a page at right angles and an arrow of the direction points to the surface, and the symbol "○" represents an occasion where an arrow is pointing to the back of a surface of a page.

At an entrance of the sheet finishing apparatus B, the sheet S on which images are formed by the image forming apparatus is conveyed by a conveyance path switching means into either one of a conveyance path for ejecting the sheet as it is without processing it and a conveyance path for conducting center-folding process and center-binding process.

A plurality of sheets S fed into the conveyance path for conducting center-folding process and center-binding process are center-folded under the condition that they are stacked. Then, they are placed on an inversed-V-shaped loading means, and they are subjected to center-binding after the number of loaded sheets reaches the prescribed number. Thus, they are taken out by a sheet-taking-out means and are ejected out after being subjected to edge cutting carried out by the sheet cutting apparatus.

First, a conveyance path for sheet S which has entered conveyance path R1 will be explained as follows, referring to FIG. 2.

Sheet S which has been fed into conveyance path R1 by conveyance path switching device G1 is pinched by conveyance rollers 203-207 to be conveyed, and is conveyed to conveyance path R3 above conveyance path switching device G2 or to conveyance path R4 under conveyance path switching device G2.

Sheet S which has been conveyed to the path R3 above conveyance path switching device G2 is ejected by sheet-ejection roller 208 to sub-sheet-ejection tray (top tray) 209 arranged on the upper portion of the sheet finishing apparatus B.

Sheet S which has been conveyed to the path R4 under conveyance path switching device G2 is pinched by conveyance rollers 210-213 to be conveyed, and is fed by sheet-ejection roller 214 into another sheet finishing apparatus.

Next, conveyance of sheet S which has entered conveyance path R2 will be explained as follows, referring to FIG. 2 and FIG. 5.

Sheet S which has been fed into conveyance path R2 by conveyance path switching device G1 is conveyed in the reverse Y direction, and is stopped temporarily at the prescribed position (position P1 shown in the figure), to be stored.

At the position P1, succeeding several sheets S are superposed on the aforesaid sheet S to be stored.

Although the number of the aforesaid sheets to be stored is three in the present embodiment, the number of sheets to be stored is not limited to this, and it can be set properly.

Three sheets S stored at the position P1 are conveyed in the Z direction by conveyance rollers 215 and 216 and by guide plate (not shown), then, are deviated to be in the X direction and are stopped temporarily at position P2 (conveyance path R5).

Incidentally, in the explanation below, sheet bundle SS means superposed plural sheets, unless otherwise specified.

Sheet bundle SS stopped temporarily at position P2 is conveyed in the Y direction by conveyance rollers 217 and 218 and by a guide plate at prescribed timing, and then is deviated to be in the inversed-Z direction (conveyance path R6).

The sheet bundle SS deviated to be in the inversed-Z direction is conveyed by conveyance-adjustment belt 220 to the center-folding means 230.

Now, the center-folding device 230 will be explained by the use of FIG. 3.

In the present embodiment, the direction of the long side of the sheet bundle SS agrees with the direction of conveyance of the conveyance-adjustment belt 220, in construction.

The center-folding device 230 is composed of adjustment member 232, center-folding rollers 234 and 235 and center-folding knife 236.

The adjustment member 232 is arranged at the position which is far from the contact point between center-folding rollers 234 and 235 by a length equivalent to a half of the length of the long side of the sheet bundle SS.

The sheet bundle SS which has been conveyed in the inversed-Z direction is pushed by adjustment claw 221 provided on conveyance-adjustment belt 220 to be conveyed on guide plate 251 constituting center-folding sheet-conveyance device 250 described later, and the sheet bundle SS stops at the position where the tip portion of the sheet bundle SS hits the adjustment member 232.

Then, the conveyance-adjustment belt 220 rotates regularly and inversely so that the adjustment claw 221 may retreat and advance, whereby, the rear end of the sheet bundle SS (three sheets) is pressed and an edge of each sheet is trued up the width of the sheet bundle SS is aligned.

After the completion of the aligning operation stated above, center-folding knife 236 provided under the contact point between center-folding rollers 234 and 235 pushes up the center portion of the sheet bundle SS in the long side direction on the guide plate 251, and pushes the sheet bundle SS into the center-folding rollers 234 and 235 rotating respectively in the directions of arrows shown in the figure.

The intruded sheet bundle SS is folded by the center-folding rollers 234 and 235 to have a fold on the central portion in the long side direction. Then, the intruded sheet bundle SS is returned on the guide plate 251 by inverse rotation of the center-folding rollers 234 and 235 to be conveyed in the X direction by center-folding sheet-conveyance means 250 described later.

There is arranged so that the adjustment member 232 and operation of conveyance adjustment belt 220 are changed by an unillustrated control device, corresponding to the sheet size, when the sheet size is changed.

Incidentally, it is also possible to conduct Z-folding (folding in three) for sheet bundle SS by the use of roller 237 and folding knife 238.

In FIG. 2 and FIG. 5 again, the sheet bundle SS having a fold at the center portion in the direction of its long side is conveyed by conveyance claw 252 provided on a conveyance belt of center-folding sheet conveyance device 250 and by an unillustrated guide plate in the X direction, and is placed on loading device 310 (conveyance path R7).

Next, the loading means 310, stapling device 350 constituting a center-binding device and staple-catching device 370 will be explained by using FIG. 4.

The loading device 310 is composed of, inversed-V-shaped fold supporting member 311 and inversed-V-shaped edge supporting member 312, and the fold supporting member 311 supports a portion near fold a on a surface of valley side (bottom surface) of the folded sheet bundle SS, while, the edge supporting member 312 supports an edge portion on a surface of valley side of the folded sheet bundle SS.

The surface of a downhill side of the folded sheet bundle SS in this case means a surface of a sheet that faces the other side surface in the inner side when the sheets are folded along the fold, and the surface of a sheet on the outer side is called a surface of an uphill side.

Above the loading device 310, there are arranged holding device 330 movable in the vertical direction and fixed stapling device 350.

Below the fold of the loaded sheet bundle SS, there is arranged staple-catching device 370 capable of moving vertically.

A combination of the stapling device 350 and staple-catching device 370 both representing a sheet binding device is arranged on each of two locations which are positioned respectively on a different side about a line of the fold of the sheets.

In the structure mentioned above, when the number of the sheet bundles SS loaded on the loading device 310 arrives at the prescribed value, the holding device 330 is lowered to hold the sheet bundle SS. Under that condition, the staple-catching device 370 rises, and a staple is stapled by the stapling device 350 on each of two locations on the fold portion of the sheet bundle SS.

Next, FIG. 2 and FIG. 4 are used to explain how to take out sheet bundle SS which has been subjected to center-binding processing.

Taking out device 420 that takes out sheet bundle SS is composed of a supporting device and a driving device (both of them are not shown).

Supporting device 421 has therein supporting members 422 and 423 which are arranged respectively on both ends of the sheet bundle SS loaded on the loading device 310, and the supporting members 422 and 423 are formed by bar-shaped members having respectively 422A and 423A each being bent on its one end at right angles to support the fold portion of the sheet bundle SS.

The other end of each of the supporting members 422 and 423 is supported rotatably on supporting shaft 424.

Each of the supporting members 422 and 423 is constructed so that it may be inserted in or removed from the fold portion of the sheet bundle SS by the driving device, to support the loaded sheet bundle SS, when viewed in the horizontal direction in FIG. 2.

As shown in FIG. 4, each of the supporting members 422 and 423 is further swung by the driving device around the supporting shaft 424 between the position where the sheet bundle SS loaded on the loading device 310 is taken out and the transferring position where the sheet bundle SS is moved and loaded on receiving conveyor 500.

In such a structure, when the number of sheet bundle SS loaded on the loading means 310 arrives at a prescribed value, and center-binding processing by the center-binding means is completed, the supporting members 422 and 423 are inserted in the portion near the fold of the loaded sheet, and support the fold portion of the sheet bundle SS. After that, the supporting members 422 and 423 swing from the taking-out position to the receiving position to load on the receiving conveyor 500 the sheet bundle SS which is gripped by grip 501.

The sheet bundle SS gripped by the grip 501 is conveyed down obliquely, interlocking with rotation of the receiving conveyor 500, to be received by cutting conveyor 600 after being released from the grip 501.

After the sheet bundle SS has been received on the cutting conveyor 600, a posture of the cutting conveyor 600 is changed to be horizontal. Then, the sheet bundle SS is conveyed toward cutting device 700 and stops at the prescribed position. Thus, an uneven edge (free end portion opposite to the fold) is cut by the cutting device 700 related to the invention, whereby, sheets are trued up and the edge is aligned.

After completion of cutting processing, the sheet bundle SS is conveyed by cutting conveyor 600 in the reverse direction, and then, falls from a tip portion of the cutting conveyor 600 in the arrowed direction to be collected by collection conveyor 900, and is ejected out to sheet-ejection tray 950 that is arranged on the outer front side of sheet finishing apparatus B.

Next, introduction of a sheet bundle in the cutting device 700 related to the present embodiment will be explained, referring to FIG. 6.

First, a mechanism to transfer the center-folded and center-bound sheet bundle SS from the receiving conveyor 500 to the cutting conveyor 600, and to stop it, after transferring, at the prescribed position for cutting an edge by the cutting device 700, will be explained, referring to FIG. 6.

Figure 6:
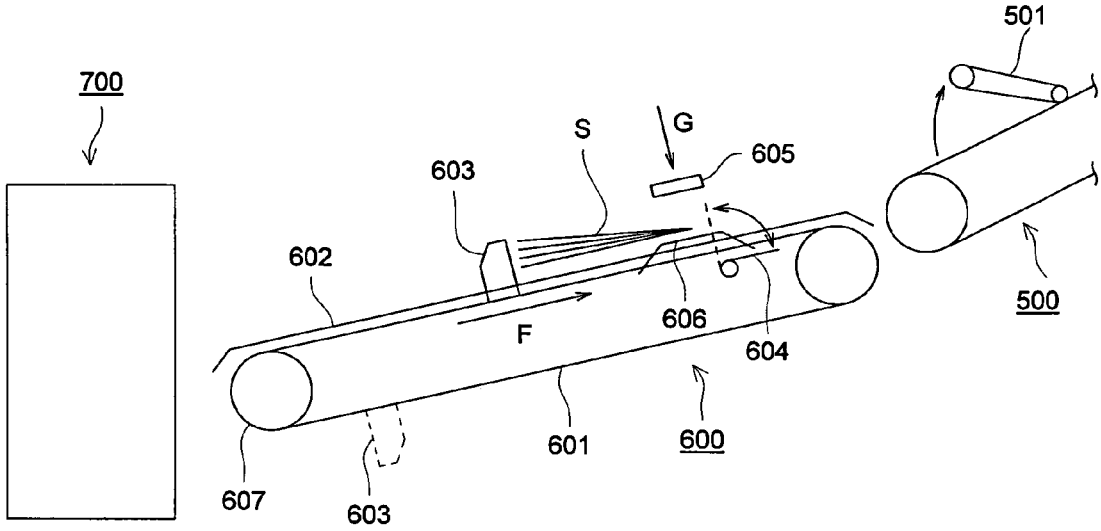
FIG. 6 is a schematic view of cutting conveyer 600 and bundle of sheets SS.
Figure 6:
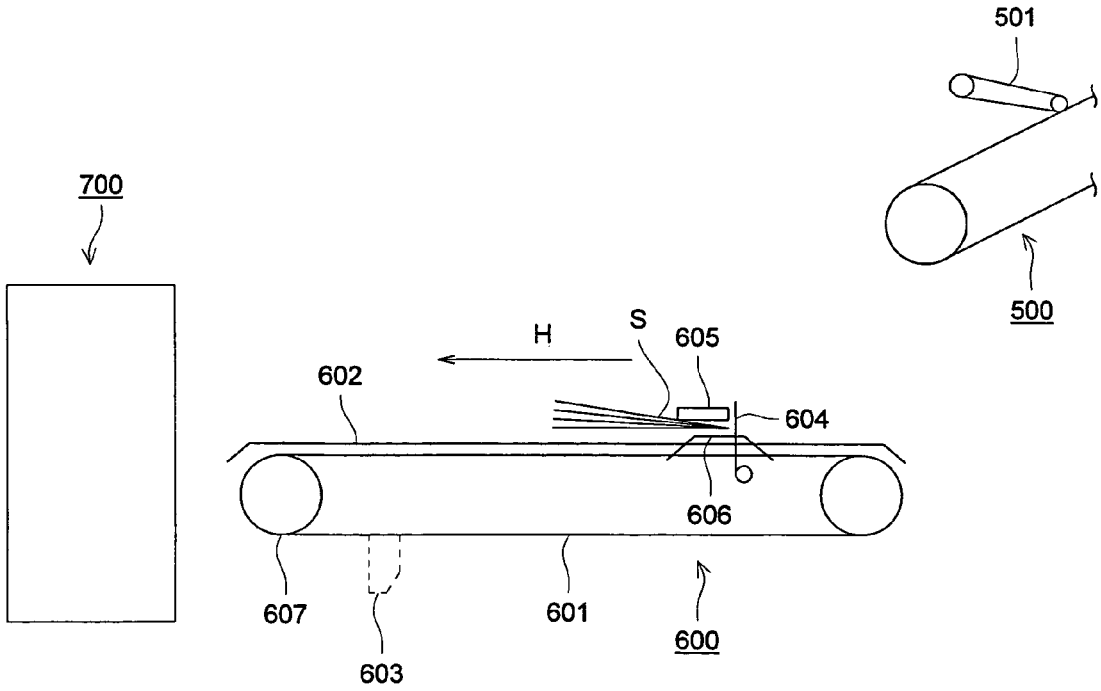

FIG. 6 is a schematic diagram of cutting conveyor 600 and of a conveyance mechanism for sheet bundle SS.

As shown in FIG. 6(*a*), grip 501 opens near the end point on the downstream side in the conveyance direction for receiving conveyor 500, and releases the sheet bundle SS which has been gripped.

The sheet bundle SS thus released approaches a belt on the upper side of conveyance belt 601 in the cutting conveyor 600 that is inclined and stopped, then, slides on an inclined surface of sheet table 602 provided to be in parallel, and hits stopper claw 603 fixed on the conveyance belt 601 to stop.

After the stop of the sheet bundle SS, adjustment member 604 is lifted from the position shown with a solid line to the position shown with a dotted line in the drawing.

After the adjustment member 604 is lifted, conveyance belt 601 moves in the direction shown with arrow F in the so that stopper claw 603 makes the fold portion of the sheet bundle SS to hit the adjustment member 604, and then, the conveyance belt 601 stops.

The skew of the sheet in the sheet conveyance direction is corrected by making the sheet bundle SS to hit the adjustment member 604 as stated above.

After the stopper claw 603 stops, fold-holding member 605 goes down in the direction shown with arrow mark G in the drawing to grip the sheet bundle SS between receiving plate 606 provided to have a plane substantially the same as the sheet table 602 and the fold-holding member 605.

After completion of gripping of the sheet bundle SS, cutting conveyor 600 rotates and stopper claw 603 retreats to the position shown with dotted lines in the drawing.

After the retreat of the stopper claw 603 is completed, the adjustment member 604, the fold-holding member 605 and the receiving plate 606 swing, while gripping the sheet bundle SS, together with cutting conveyor 600 integrally to the horizontal position shown in FIG. 6(*b*) on a fulcrum represented by the center of pulley 607 of the cutting conveyor 600, and stops there.

After swinging of the cutting conveyor 600 is completed, the sheet bundle SS moves, while being gripped between fold-holding member 605 and receiving plate 606, in the direction of arrow H in the drawing while sliding on the sheet table 602, and stops at the position that is determined depending on a size of each sheet.

The sheet bundle SS stopped at the prescribed position is subjected to edge cutting carried out by sheet cutting apparatus 700.

Figure 7:
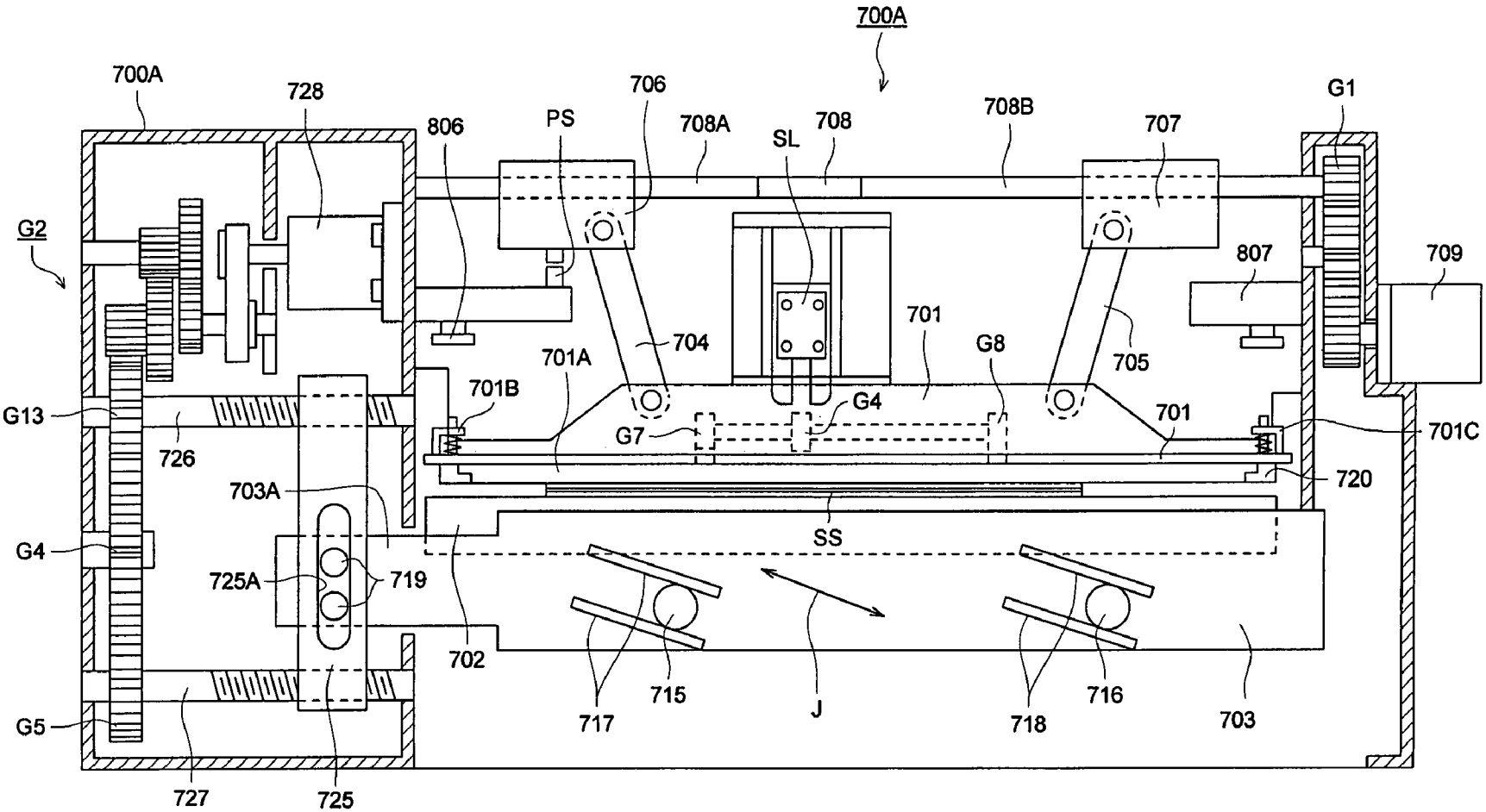
FIG. 7 is a front view of sheet cutting apparatus 700 related to the embodiment of the invention.
Figure 8:
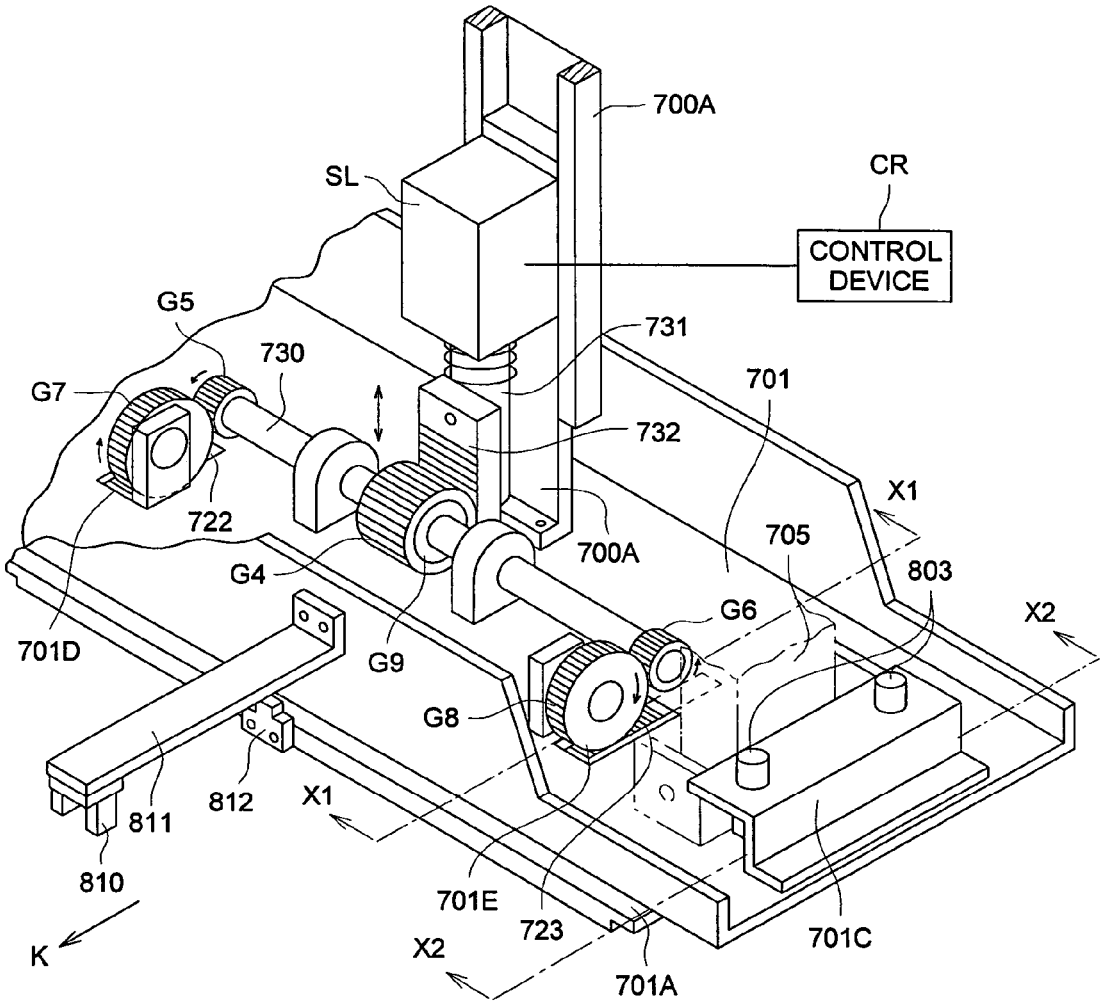
FIG. 8 is a perspective view of a sheet-pressing member.
Figure 9:
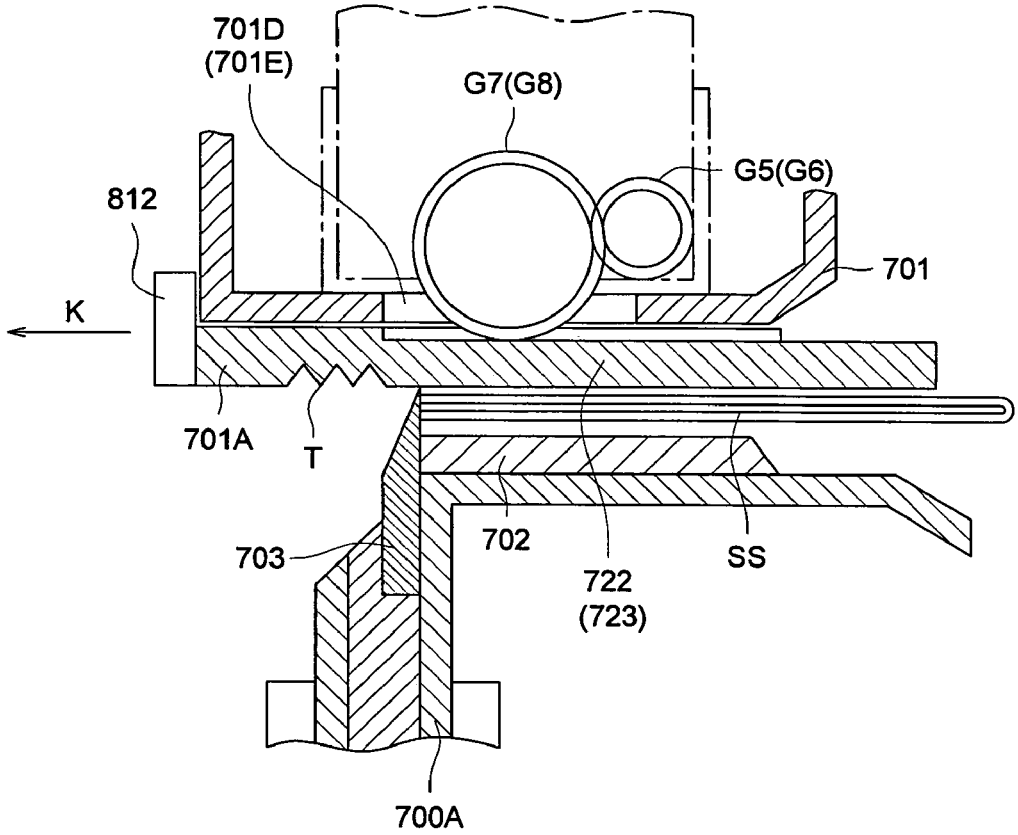
FIG. 9 is a sectional view taken on line X1-X1 in FIG. 8.

Next, the sheet cutting apparatus 700 will be explained, referring to FIGS. 7-13, FIG. 7 is a front view of the sheet cutting apparatus, FIG. 8 is a perspective view of a sheet-pressing member, and FIG. 9 is a sectional view taken on line X1-X1 in FIG. 8.

On the upper portion of the sheet cutting apparatus 700, there is provided shaft 708 that is supported by frame 700A of the sheet cutting apparatus. On the shaft 708, there are provided male screw portions 708A and 708B which are opposite-handed each other, and the male screw portion 708A is screwed in female screw unit 706 and the male screw portion 708B is screwed in female screw unit 707.

Sheet-pressing member 701 movable vertically is connected with female screw unit 706 by connection bar 704 and sheet-pressing member 701 is connected with female screw unit 707 by connection bar 705. Namely, an upper end of the connection bar 704 is rotatably supported by female screw unit 706, and a lower end thereof is rotatably supported by the left end portion of the sheet-pressing member 701. In the same way, an upper end of the connection bar 705 is rotatably supported by female screw unit 707, and a lower end is rotatably supported by the right end portion of the sheet-pressing member 701. The shaft 708 is connected with motor 709 through gear G1, thus, rotation of the motor 709 moves the female screw units 706 and 707 respectively toward left and right, whereby inclination of each of connection bars 704 and 705 changes and moves sheet-pressing member 701 vertically on a parallel displacement basis.

As stated above, the motor 709, the shaft 708, female screw units 706 and 707 and connection bars 704 and 705 constitute a holding member driving mechanism that moves the sheet-pressing member 701 vertically to be in parallel.

The sheet bundle SS is held between fixed supporting table 702 and cutting board 701A. Since the sheet-pressing member 701 is driven by a driving mechanism having a large reduction gear ratio including male screw portions 708A and 708B, it presses sheet bundle SS under the high pressure.

On cutting blade 703 on which a cutting edge is formed on the upper end portion, there are fixed rollers 715 and 716 which are guided respectively by guide members 717 and 718 inclined downward to the right. The guide members 717 and 718 are fixed on the frame 700A, though they are not illustrated.

Cutting blade driving member 725 is driven by male screw portions 726 and 727 to move from side to side in parallel. The male screw portions 726 and 727 are driven by motor 728 through gears G2-G5. On the cutting blade driving member 725, on the other hand, there is provided vertical elongated hole 725A, and the elongated hole 725A engages with two pins 719 fixed on base portion 703A of cutting blade 703.

Motor 728, gears G2-G5, male screw portions 726 and 727 and cutting blade driving member 725 constitute a cutting blade driving mechanism for cutting blade 703, and the cutting blade 703 is moved from side to side by the rotation of the motor 728. The cutting blade 703 is guided by guide members 717 and 718 to move in the oblique direction that is composition of a horizontal component and a vertical component, namely, to move in the direction shown with arrow J. In this way, the cutting blade 703 is driven by the motor 728 to move obliquely as shown with arrow mark J.

As shown in FIG. 8, a bottom portion of the sheet-pressing member 701 is composed of cutting board 701A, and the cutting board 701A is held by a rail (described later) provided on the end portion of the sheet-pressing member 701. When set to the retreated position, the sheet-pressing member 701 can slide in the direction that is perpendicular to the longitudinal direction of the cutting blade 703 as shown with arrow K, namely, in the direction perpendicular to the cutting blade surface.

On the upper surfaces of both end portions of the cutting board 701A., there are formed respectively racks 722 and 723, and each of these is exposed to the upper portion through each of openings 701D and 701E which are provided on the sheet-pressing member 701.

The racks 722 and 723 engage respectively with pinions G7 and G8 which further engage respectively with gears G5 and G6 which are fixed respectively on both end portions of shaft 730. The shaft 730 is connected with solenoid SL through one-way clutch G9 and gear G4. Namely, rack 732 fixed on plunger 731 of the solenoid SL engages with gear G4, whereby, the shaft 730 is driven by one-way rotation of the gear G4.

Through the function of the one-way clutch G9, only upward movement of the plunger 731 that takes place when the solenoid SL is turned on is transferred to the gear G4, and downward movement of the plunger 731 that takes place when the solenoid SL is turned off is not transferred to the gear G4.

Solenoid SL, plunger 731, one-way clutch G9, gears G4-G8 and racks 722 and 723 constitute a movable unit that moves cutting board 701A, and an operation of the solenoid SL makes the cutting board 701A to advance in the direction of arrow K.

By using the solenoid SL and one-way clutch G9, movement of the cutting board 701A is realized by a simple and small-sized mechanism.

Next, operations of cutting device 700 will be explained.

Under the state of standing by, sheet-pressing member 701 is at an upper limit position with female screw unit 706 positioned at a left end portion and with female screw unit 706 positioned at a right end portion.

When sheet bundle SS is introduced in the cutting device 700, motor 709 is started to drive female screw units 706 and 707, and sheet-pressing member 701 falls. When the sheet-pressing member 701 falls to the position where it holds the sheet bundle SS, resistance for driving increases suddenly, and an overcurrent flows through the motor 709. Then, signals resulted from detection of the overcurrent of the motor 709 stops the motor 709. In the case of cutting which will be explained later, the sheet-pressing member 701 presses the sheet bundle SS with high pressure so that no slip may be caused even when cutting blade 703 applies horizontal force to numerous stacked sheets.

At the moment when pressing of the sheet bundle SS has been completed, motor 728 starts to move the cutting blade 703 upward to the left as shown with arrow J. The sheet bundle SS is cut by this movement of the cutting blade 703. Since the cutting operation of the cutting blade 703 is based on sliding of the cutting blade 703, cutting by relatively small driving force is possible. Because the cutting blade 703 cuts the loaded sheets one by one. So even when the number of sheets to be cut is increased, the driving force remains unchanged with only exception that a stroke of the cutting blade is changed.

After all of the loaded sheets are cut, a tip of the cutting blade 703 comes in contact with cutting board 701A, and resistance for driving of the cutting blade 703 is increased. This increase of resistance for driving, namely, an increase of motor driving current caused by an increase of load for motor 709 is detected, and motor 709 is stopped by signals of this detection, whereby, all of the sheets constituting the sheet bundle SS are cut.

After completion of edge cutting processing, the motor 728 rotates inversely, and the cutting blade 703 goes down to the prescribed position that is obliquely downward on the right side in FIG. 7.

When a descent of the cutting blade 703 is completed, the sheet-pressing member 701 goes up to its initial position.

When fold-holding member 605 that has gripped the neighborhood of the fold portion of the sheet bundle SS and receiving plate 606 return respectively to the positions shown in FIG. 6(*b*), after completion of an ascent of the sheet-pressing member 701, the fold-holding member 605 goes up and adjustment member 604 retreats to be lower than a sheet conveyance plane, whereby gripping of the sheet bundle SS is released.

Continuously, cutting conveyor 600 rotates, and sheet bundle SS whose edge has been cut is dropped by stopper claw 603 from the tip portion of the cutting conveyor 600 in the arrow direction. And the sheet bundle SS is conveyed by rotating collection conveyor 900 to be ejected out to sheet-ejection tray 950 that is arranged on the outer front side of sheet finishing apparatus B.

Through the aforesaid series of operations, the edge cutting processing for one sheet bundle SS is completed.

The cutting board 701A is made of resin such as polypropylene. The cutting board 701A is cut off by cutting blade 703 little by little in the course of repeating cutting operations, resulting in engraved grooves T formed on the cutting board 701A. When these engraved grooves T become deeper, there are sometimes caused cutting failures such as that sheets are left uncut or an end face of the cut edge is not smooth.

As explained above, an unused portion of cutting board 701A is set to the position where the blade tip of cutting blade 703 is rested, by displacing the cutting board 701A in the direction K crossing the longitudinal direction of the cutting blade 703. Namely, when the solenoid SL is operated, the moving device explained earlier operates to cause the cutting board 701A to advance by a prescribed length in the K direction.

Owing to this, it is possible to restrict a depth of engraved groove within the permissible limit, and therefore, cutting failures resulting from engraved grooves are not caused, though plural engraved grooves T are formed as shown in FIG. 9.

Control device CR in FIG. 8 counts the number of times of cutting operations, and when the counted value arrives at a prescribed value, for example, 700 times, solenoid SL is operated to displace the cutting board 701A.

FIG. 10 shows both end portions of the sheet-pressing member 701.

On the both end portions of the sheet-pressing member 701, Z-shaped supporting plates 701B and 701C are fixed with screws. Below the supporting plates 701B and 701C, there are provided holding members 800 and 801 which respectively hold both ends of the cutting board 701A.

The holding member 800 is composed of holding block 800A and rail forming member 800B, both of which are fixed to each other by screw 800C. The rail forming member 800B supports cutting board 701A, and forms a rail that guides movement of the cutting board 701A in the direction perpendicular to the surface of a page on FIG. 10.

A hole is formed on the holding block 800A, and pin 802 fits in the hole. An upper portion of the pin 802 fits in a hole formed on the supporting plate 701B, and a lower portion of the pin 802 is formed to be large diameter portion 802B as shown with a trapezoid section, and is engaged with a trapezoid-shaped portion of the hole on the holding block 800A. Therefore, the pin 802 is constructed so that it may move vertically while being guided by the holes, for the supporting plate 701B and the holding block 800A, but it cannot come out upward. On the pin 802, there is formed stopper 802A, and compression-type coil spring 804 lies between the stopper 802A and sheet-pressing member 701. The holding member 800 is lifted upward by the urging force of the coil spring 804A, and the cutting board 701A comes into close contact with sheet-pressing member 701 to be connected each other as shown in FIG. 10(*a*).

A hole is formed on the holding block 801A, and pin 803 fits in the hole. An upper portion of the pin 803 fits in a hole formed on the supporting plate 701C. A lower portion of the pin 803 is formed to be large diameter portion 803B as shown with a trapezoid section, and is engaged with a trapezoid-shaped portion of the hole on the holding block 801A. Therefore, the pin 803 is constructed so that it may move vertically while being guided by the holes, for the supporting plate 701C and the holding block 801A, but it cannot come out upward. On the pin 803, there is formed stopper 803A, and compression-type coil spring 805 lies between the stopper 803A and sheet-pressing member 701. The holding member 801 is lifted upward by the urging force of the coil spring 805A, and the cutting board 701A comes into close contact with sheet-pressing member 701 to be connected each other as shown in FIG. 10(*a*).

The cutting board 701A and the sheet-pressing member 701 are connected closely each other to be united solidly by urging forces of springs 804 and 805, as explained above.

Figure 11:
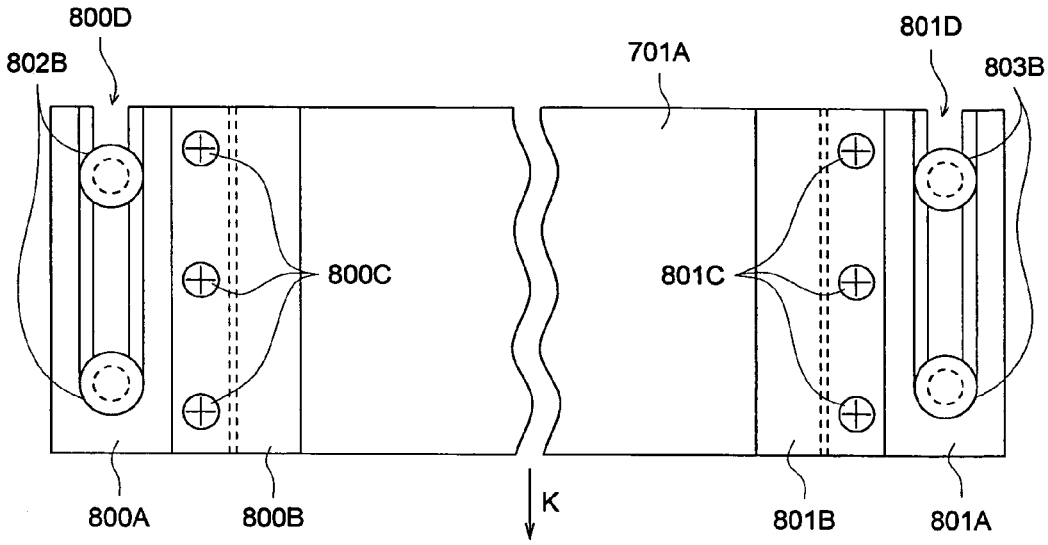
FIG. 11 is a diagram of a bottom surface of cutting board 701A.

FIG. 11 is a diagram of the bottom surface of the cutting board 701A.

As shown in FIG. 11, rail forming member 800B is fixed on holding block 800A with three screws 800C, and rail forming member 801B is fixed on holding block 801A with three screws 801C.

Elongated hole 800D is formed on the holding block 800A, and two pins 802 are engaged with the elongated hole 800D, and elongated hole 801D is formed on the holding block 801A, and two pins 803 are engaged with the elongated hole 801D.

A cutting process to cut a sheet bundle is carried out under the state shown in FIG. 10(*a*). At the stage where the cutting processes in prescribed times (for example, 700 times) have been carried out, sheet-pressing member 701 is lifted by a holding member driving mechanism whose driving source is motor 709 explained earlier. FIG. 10(*b*) shows the state where the sheet-pressing member 701 has risen to the upper limit position.

Under the condition shown in FIG. 10(*b*), an upper end of the pin 802 hits projection 806 which is provided on the frame of the sheet cutting apparatus as a releasing member, and an upper end of the pin 803 hits projection 807 representing a releasing member.

Due to this, the pins 802 and 803 go down relatively to sheet-pressing member 701, against urging force of springs 804 and 805. As a result, the cutting board 701A leaves the sheet-pressing member 701. Accordingly, the cutting board 701A can move relatively to the sheet-pressing member 701, and under this condition, moving device that moves cutting board 701A explained earlier operates to move the cutting board 701A in the direction perpendicular to the surface of a page on FIG. 10. Whereby, an unused portion of the cutting board 701A is set to the position where the blade is received. In the course of this replacement of the cutting board 701A, the cutting board 701A moves in the direction K shown in FIGS. 8, 9 and 11, while being guided by pin 802 and elongated hole 800D and by pin 803 and elongated hole 801D.

As explained above by using FIGS. 10 and 11, pins 802 and 803 as well as springs 804 and 805 constitute a connecting device that connects cutting board 701A removably to sheet-pressing member 701. In the course of sheet cutting process, the cutting board 701A is connected by the connecting device to the sheet-pressing member 701 to be united solidly. While, when the sheet-pressing member 701 is in its retreated position, the connection of the sheet-pressing member 701 and the cutting board 701A is released, and an unused portion of the cutting board 701A is set to the position where the blade is received.

Further, it is also possible to replace cutting board 701A with new one under the state where the aforesaid connection is released.

Figure 14:
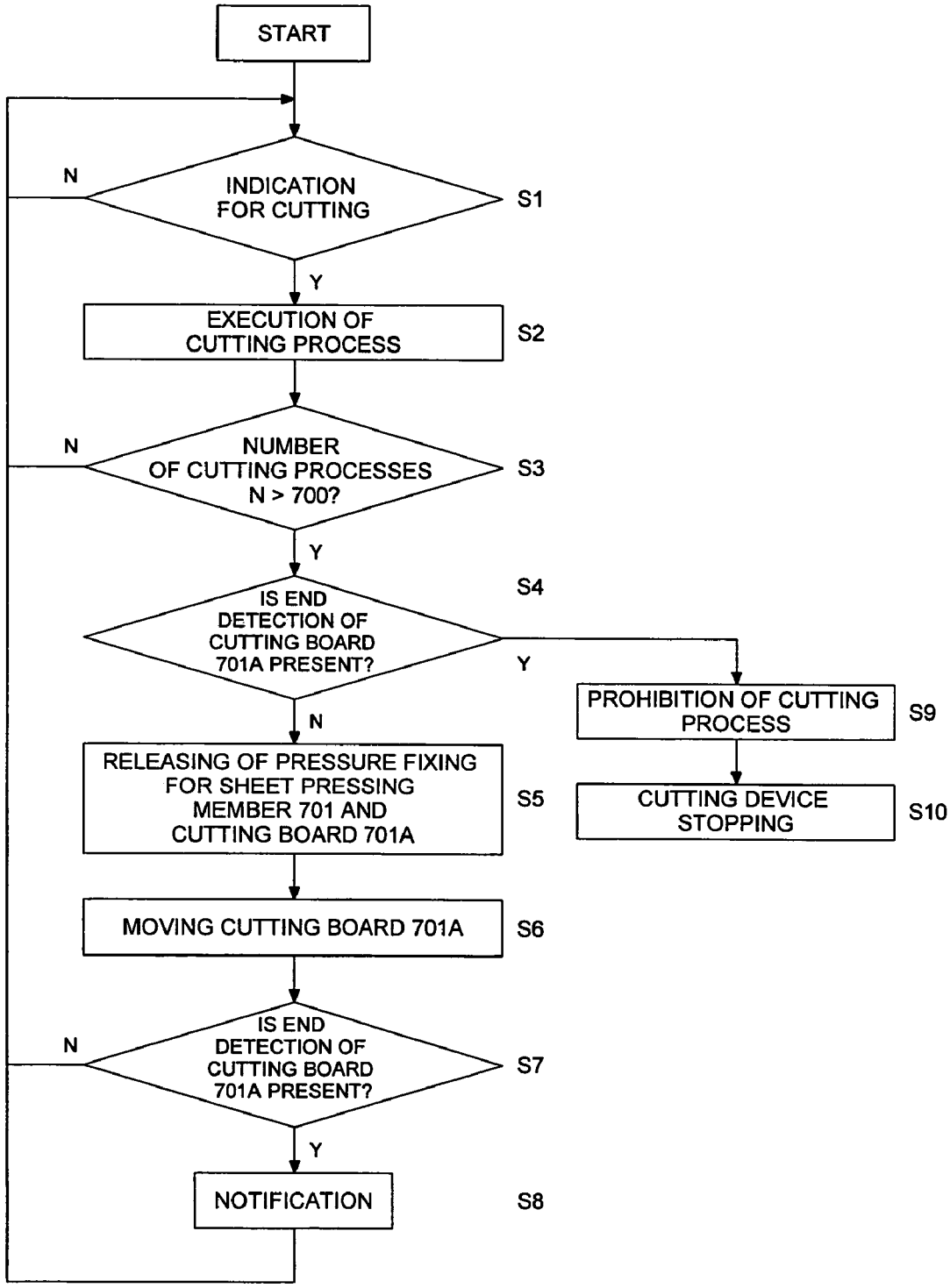
FIG. 14 is a flow chart showing the processing related to cutting process and detection of a movable end of the cutting board.

FIG. 14 is a flow chart showing the processing related to cutting process and detection of a movable end of the cutting board.

First, whether the signal from the main body is present or not is confirmed, or whether the indication for sheet cutting is present for the sheet finishing apparatus or not is confirmed (S1). In accordance with this, sheet cutting process is executed (S2). After that, a judgment is formed for whether the number of times of cutting operations has exceeded the prescribed number of times (a value of 700 times is set, in this case) or not (S3). The number of times of cutting operations means the number of times of cutting operations executed after the preceding movement of the cutting board 701A.

When the number of 700 times is not exceeded, an indication for the following cutting process is waited. When the number of 700 times is exceeded, the cutting board 701A is moved. In advance of this, pressure fixing between the cutting board 701A and the sheet-pressing member 701 is released (S5). After that, the cutting board 701A is moved by a prescribed distance (S6).

After the movement of the cutting board 701A, whether the movable end of the cutting board 701A has been detected or not is confirmed again (S7), and when the movable end of the cutting board 701A is not detected in S7, an indication for the following cutting process is waited. When the movable end of the cutting board 701A has been detected, notification (display of replacement message) is carried out (S8) to wait an indication for the following cutting operation. In this arrangement, the message notifies that the cutting board 701A is in a time of replacement. Then, a user has only to replace the cutting board 701A after the message is notified, before next 700 times of cutting operations are finished. Therefore, inconvenience that a cutting operation is stopped immediately after detection of the movable end can be solved, and the cutting board 701A can be replaced with time on hand, which improves ease of use for the user.

On the other hand, when the movable end of the cutting board 701A is detected in S4, cutting processing is prohibited (S9), and a sheet cutting apparatus is stopped (S10). In this case, the sheet cutting apparatus is started again after the replacement of the cutting board 701A.

Incidentally, it is also possible to employ the structure to conduct prohibition of cutting processing and to conduct notification without stopping a sheet cutting apparatus, when the movable end is detected in S4.

Detection of a movabler end of a cutting board will be explained, referring to FIGS. 8, 12 and 13.

Figure 12:
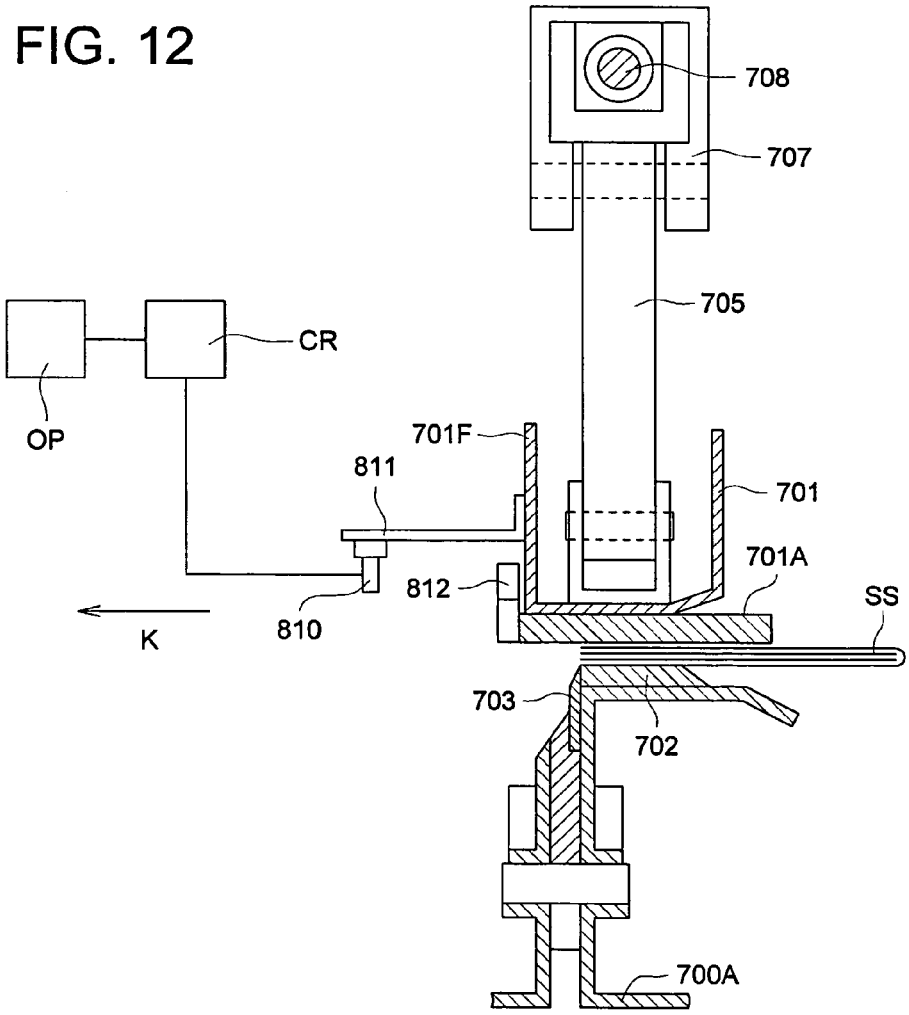
FIG. 12 is a sectional view taken on line X2-X2 in FIG. 8.
Figure 13:
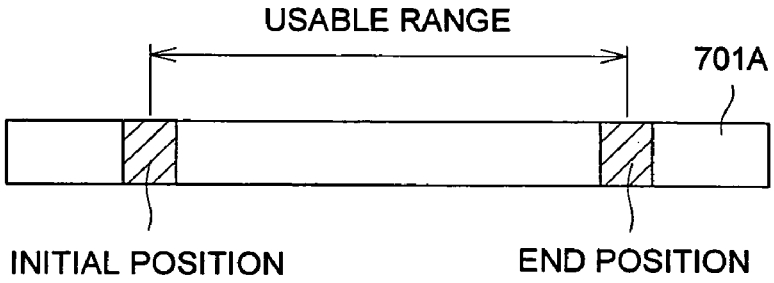
FIG. 13 is a diagram showing a usable range of the cutting board.

FIG. 12 is a sectional view taken on line X2-X2 in FIG. 8, and FIG. 13 is a diagram showing a range of a usable portion of the cutting board 701A.

Sensor 810 representing a movable end detector made of photo-interrupter is fixed on lifted portion 701F provided on sheet-pressing member 701, through supporting arm 811. On the other hand, actuator 812 in a form of a protrusion detected by the sensor 810 is fixed on an end portion of the cutting board 701A.

As shown in FIG. 13, the cutting board 701A can be used from a moment of the initial position where its left end portion receives cutting blade 703 until reaching a moment when the movable end position on the right end is set to the position for receiving cutting blade 703, by moving stepwise in the direction shown with K by assistance of the moving device. The supporting arm 811 has a length corresponding to the aforesaid range of use, and the cutting board 701A is driven by the moving device stated earlier to move. And sensor 810 detects actuator 812 when the usable range of the cutting board 701A is used up. Namely, when the end position of the cutting board 701A is displaced at a position opposed to the cutting blade 703, the movable end is detected by the detector, such as the sensor 810 and actuator 812.

OP represents a display section representing a notifying section of image forming apparatus A. Control device CR receives a detection signal when sensor 810 detects actuator 812. In accordance with this, the control device CR prohibits cutting operations, and operates the display section OP to indicate a display for warning replacement of cutting board 701A on the display panel.

As another example of movable end detection, it is possible to detect a movable end based on the number of times for movement, by obtaining the number of times for movement representing the movable end, based on a distance of a single movement of cutting board 701A. In this case, the control device CR works as a movable end detector. Specifically, every time the cutting board 701A is moved by the control device CR, the number of times for movement is stored, and when the number of times for movement arrives at the number of times established in advance considering the movable end, it is judged that the movable end has come. Based on this, operations of notification and of stop of cutting are conducted. For example, if the movable end comes after moving the cutting board 701A 10 times, in the case of moving the cutting board 701A for every 700 times, the movable end is to be detected after 7000 times of cutting operations, to execute operations thereafter.

The invention makes it possible to realize a sheet cutting apparatus wherein high cutting capacity is always maintained and maintenance for keeping the cutting capacity is easy.

It is further possible to learn the time to replace a cutting board, and a device automatically stops when the cutting board is used up, whereby, cutting failure and troubles caused by exhausted cutting board can surely be prevented.

It is further possible to realize a highly reliable image forming system having a function to make a booklet and high stability for operation.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed:

1. A sheet cutting apparatus comprising:

a cutting blade having a blade tip, the blade tip to cut a set of sheets by moving in an oblique direction which includes first component of a perpendicular direction to a face of the set of sheets and second component of a parallel direction to the face;

a cutting board to receive the cutting blade at a receiving portion which contacts with the blade tip;

a movable unit to move the cutting board in a direction cross to the blade tip so that the receiving portion slides;

an end detector to detect a movable end of the cutting board; and a notifying section that notifies replacement of the cutting board based on a signal of detection conducted by the end detector.

2. The sheet cutting apparatus according to claim 1, comprising a control section that controls the sheet cutting apparatus based on results of detection conducted by the detector.

3. The sheet cutting apparatus according to claim 2, wherein the control section prohibits sheet cutting operations based on a signal of detection conducted by the end detector.

4. The sheet cutting apparatus according to claim 2, wherein the control section makes sheet cutting operations in prescribed number of times possible after detecting the movable end.

5. The sheet cutting apparatus according to claim 2, wherein the control section detects the movable end before moving the cutting board.

6. The sheet cutting apparatus according to claim 2, wherein the control section detects the movable end after moving the cutting board.

7. The sheet cutting apparatus according to claim 1, wherein the end detector has a sensor that detects a position of the cutting board.

8. The sheet cutting apparatus according to claim 1, wherein an actuator that operates the detector is provided on the cutting board.

9. The sheet cutting apparatus according to claim 1, comprising a sheet-pressing member that presses the set of sheets.

10. The sheet cutting apparatus according to claim 9, wherein the end detector is provided on the sheet-pressing member.

11. The sheet cutting apparatus according to claim 9, wherein the cutting board is pressure-fixed on the sheet-pressing member.

12. The sheet cutting apparatus according to claim 11, wherein the pressure-fixation between the cutting board and the sheet-pressing member is released when the sheet-pressing member ascends to the upper limit position.

13. The sheet cutting apparatus according to claim 11, wherein the pressure-fixation between the cutting board and the sheet-pressing member is released by regulating the rise of the cutting board when the sheet-pressing member is caused to rise to the upper limit position.

14. The sheet cutting apparatus according to claim 1, wherein a counting section that counts the number of times of sheet cutting is provided, and the cutting board is moved by the movable unit, each time the counting section counts the prescribed number of times.

15. The sheet cutting apparatus according to claim 1, wherein the movable unit has a solenoid and a one-way clutch driven by the solenoid.

16. An image forming system having the sheet cutting apparatus described in claim 1.

17. The sheet cutting apparatus according to claim 1, wherein the movable unit linearly moves the cutting board, and the end detector detects a movable end of the cutting board which moves linearly.

18. The sheet cutting apparatus according to claim 17, wherein the cutting blade cuts the set of sheets by moving upward.

* * * * *